US006640981B2

(12) United States Patent
Lafond et al.

(10) Patent No.: US 6,640,981 B2
(45) Date of Patent: Nov. 4, 2003

(54) MODULAR TEST TUBE RACK

(75) Inventors: André Lafond, St. Hilaire (CA); Yanick Bertin, Verchères (CA)

(73) Assignee: 3088081 Canada Inc., Quebec (CA)

( * ) Notice: Subject to any disclaimer, the term of this patent is extended or adjusted under 35 U.S.C. 154(b) by 0 days.

(21) Appl. No.: 09/929,112

(22) Filed: Aug. 14, 2001

(65) Prior Publication Data

US 2003/0034317 A1 Feb. 20, 2003

(51) Int. Cl.[7] ..... A47B 73/00

(52) U.S. Cl. ..... 211/74; 211/60.1; 422/104; 206/443

(58) Field of Search ..... 211/74, 194, 60.1; 422/99, 104, 102; 206/443, 446; D24/230

(56) References Cited

U.S. PATENT DOCUMENTS

| | | | | | |
|---|---|---|---|---|---|
| 4,111,754 | A | * | 9/1978 | Park | 422/101 |
| D257,390 | S | * | 10/1980 | Hahn et al. | D24/227 |
| 4,253,830 | A | * | 3/1981 | Kazen et al. | 206/368 |
| 4,284,603 | A | * | 8/1981 | Korom | 210/323.1 |
| 4,346,057 | A | * | 8/1982 | Bowser | 159/22 |
| 4,407,958 | A | * | 10/1983 | DeGraff, Jr. | 211/194 |
| 4,495,150 | A | * | 1/1985 | Cook et al. | 134/115 R |
| 4,863,023 | A | * | 9/1989 | Payne et al. | 206/364 |
| 5,080,232 | A | * | 1/1992 | Leoncavallo et al. | 206/443 |
| 5,133,939 | A | * | 7/1992 | Mahe | 211/74 |
| 5,141,117 | A | * | 8/1992 | Olsen et al. | 211/194 |
| 5,169,603 | A | | 12/1992 | Landsberger | 422/104 |
| 5,285,907 | A | | 2/1994 | Franchere et al. | 211/74 |
| D359,126 | S | * | 6/1995 | Hovatter | D24/227 |
| 5,605,160 | A | * | 2/1997 | Fishman | 600/556 |
| 5,632,388 | A | * | 5/1997 | Morrison et al. | 211/170 |
| D411,308 | S | * | 6/1999 | Pandey et al. | D24/230 |
| 5,950,832 | A | * | 9/1999 | Perlman | 206/446 |
| 5,996,818 | A | * | 12/1999 | Boje et al. | 206/443 |
| D420,743 | S | * | 2/2000 | Monks | D24/224 |
| 6,136,273 | A | * | 10/2000 | Seguin et al. | 206/443 |
| 6,171,554 | B1 | * | 1/2001 | Kalmakis et al. | 206/443 |
| 6,221,027 | B1 | * | 4/2001 | Pitesky | 206/538 |
| D448,854 | S | * | 10/2001 | Kuiper et al. | D24/227 |

* cited by examiner

*Primary Examiner*—Daniel P. Stodola
*Assistant Examiner*—Khoa Tran
(74) *Attorney, Agent, or Firm*—Patterson, Thuente, Skaar & Christensen, L.L.C.

(57) ABSTRACT

A modular test tube rack for assembly with similarly constructed racks comprise a flat rectangular body displaying, in a first position, a series of wells extending from its top wall to its bottom wall and adapt to receive tubes therein. A pair of handles vertically extend at opposite end walls of the body, each handle having a lower portion adapted to tightly engage an extension on each end wall and a hand gripping upper portion. The lower portion has a bottom edge configured to anchor with the top edge of the handle of an underposed similarly constructed rack to thereby enable a stacking of two more of these racks. In one embodiment, the body displays a second series of wells extending from the bottom wall to the top wall whereby the body, when in a second position reversed relative to the first position, may also receive test tubes, the handles being reversably mountable to the end wall extension to still enable a stacking of racks in the second position.

18 Claims, 6 Drawing Sheets

MODULAR TEST TUBE RACK

FIELD OF THE INVENTION

The present invention relates to a modular test tube rack configured for assembly with similarly constructed racks.

BACKGROUND OF THE INVENTION

Test tube racks are found in laboratories and serve to hold test tubes during various analytical and processing procedures.

Racks may be arranged in modular fashion so that a plurality of these racks can be handled as a single rack. It has been found useful to provide handles which can be connected to the rack arrangement to facilitate transportation thereby eliminating the use of trays or other handling devices.

One example of a modular test tube rack arrangement may be found described in U.S. Pat. No. 5,169,603 issued Dec. 8, 1992 to Landsberger in which a plurality of test tube racks are disposed side by side and coupled together at opposite sides by means of clamps to form a modular test tube rack arrangement. Handles engage the clamps to provide a balanced pivot handle arrangement for transporting the modular set of connected racks. Other modular tube rack arrays have been devised such as the one described in U.S. Pat. No. 5,285,907 issued Feb. 15, 1994 to Franchere et al.

The support racks for test tubes which exist presently consist of plastic blocks in which holes are perforated to form rows and columns. None, however, are configured with a universality intention in order to answer the needs of new technologies. This requires for users to have in store two types of racks: for example, one model having 80 positions strictly for micro-centrifuge tubes and a second model having 96 positions which can receive tubes of 0.5 to 2.0 ml. The 96 position models are voluminous and take a lot of place on working tables. Also, this double inventory is expensive.

Generally, the products must be stored in a restricted space, such as a freezer or a refrigerator. In order to maximize the use of such space, the racks must be juxtaposed one on top of the other, in which case the racks rest on the caps of the tubes of the rack disposed therebeneath. This results in an unstable assembly where the tubes may easily fall and break their contents lost and the storing space contaminated.

OBJECTS AND STATEMENT OF THE INVENTION

It is an object of the present invention to overcome the problems associated with presently used racks. This is achieved by providing a modular test tube rack for easy stacking assembly with similarly constructed racks.

It is also an object of the present invention to provide a rack which is reversible; in other words, a rack with its top wall being formed of wells adapted to receive a given number and size of tubes and when the body is reversed, it is configured to receive an other given number and size of tubes.

The present invention therefore relates to a modular test tube rack for assembly with similarly constructed racks, which comprises:

a flat rectangular body having a top wall, a bottom wall, opposite side walls and opposite end walls; the body displaying, in a first position, a series of wells extending from the top wall to bottom wall and adapted to receive tubes therein; each end wall displaying a handle engaging extension;

a pair of handles respectively mounted at opposite end walls; each handle having a lower portion having means adapted to tightly engage the extension of the end wall of the body and to extend vertically therefrom; each handle having a hand gripping upper portion displaying a top edge; the lower portion of the handle having a bottom edge configured to anchor with the top edge of an underposed similarly constructed rack thereby enabling a stacking of two or more of the racks.

In a preferred form of the invention, the body displays a second series of wells extending from the bottom wall to the top wall whereby, when the body is inverted to a second position inversed relative to the first position, it may receive other test tubes. The handles are reversibly mountable to the end wall extensions so as to still enable a stacking of racks when the body is in the second position.

In another form of the invention, a cover is provided which is adapted to rest on the side walls and end walls of the body in either the first or second positions.

In a further form of the invention, the opposite side walls of the body display slots in which dowels are received enabling racks to be juxtaposedly interconnected.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
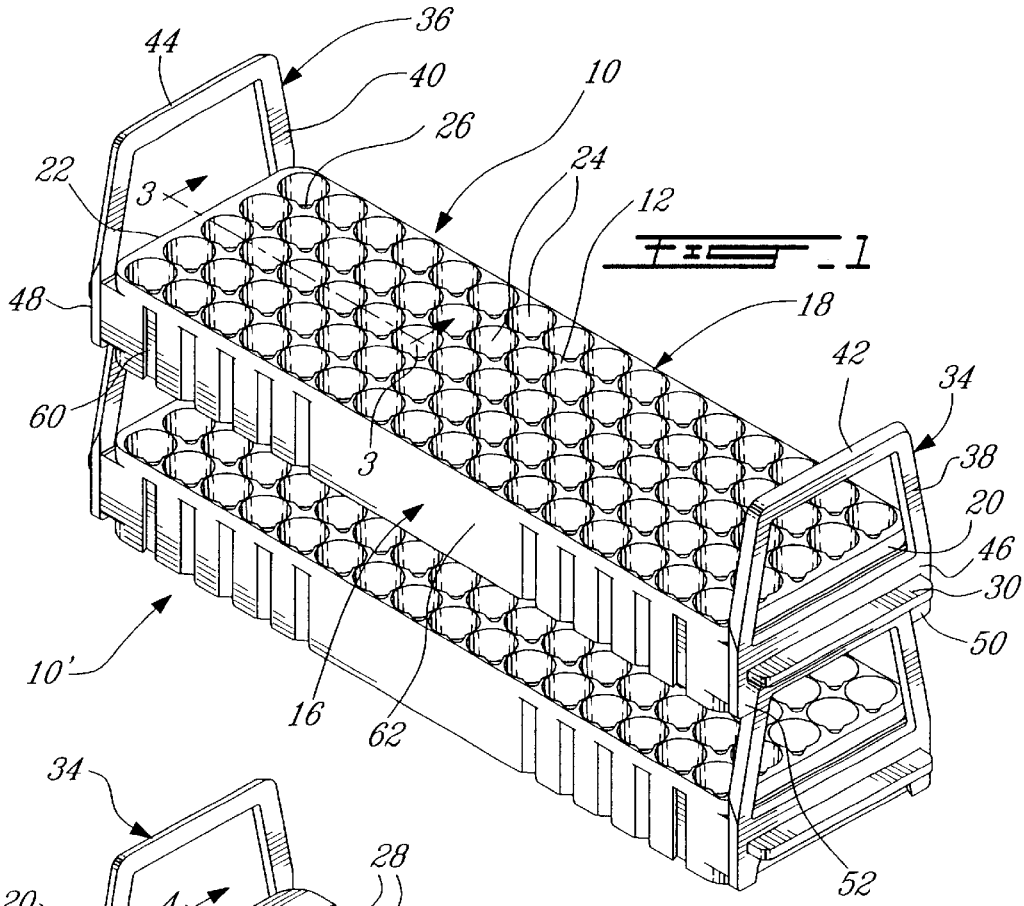
FIG. 1 is a perspective view showing two stacked racks made in accordance with the present invention with the racks shown in a first position.
Figure 2:
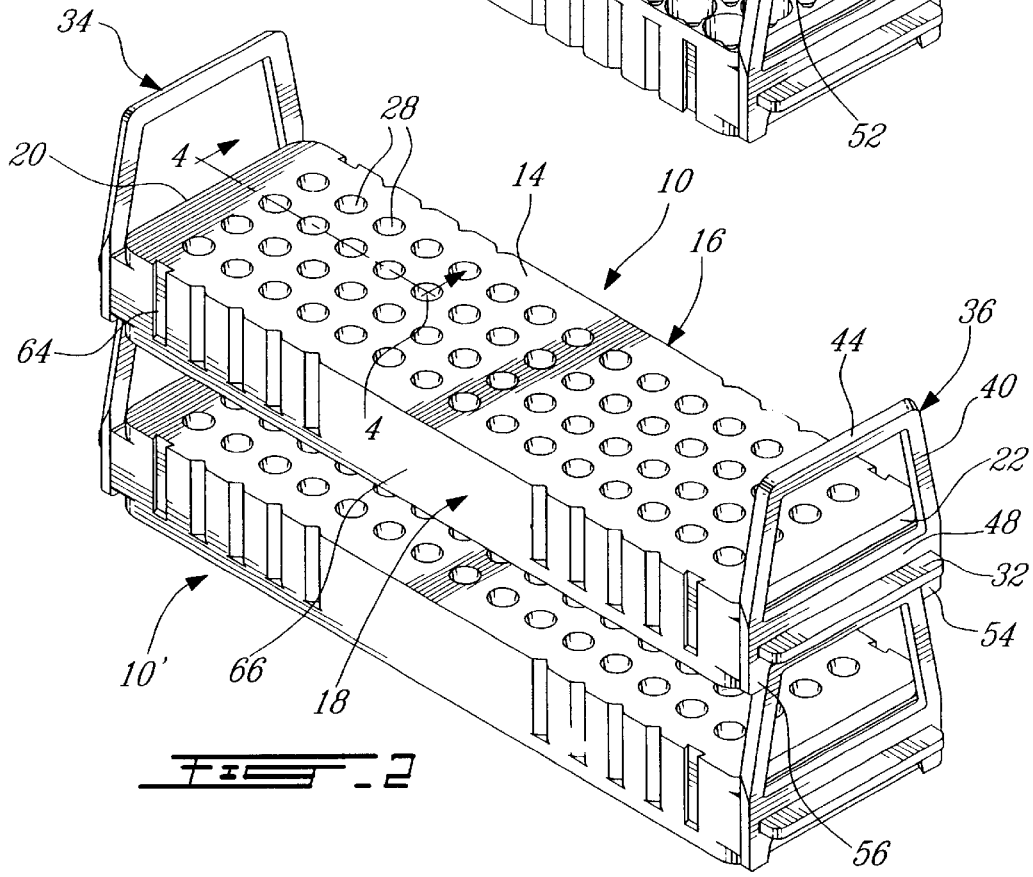
FIG. 2 is a perspective view depicting the two stacked racks in an inverted position relative to the identically constructed racks depicted in FIG. 1.

Referring to FIGS. 1 and 2, there are shown two stack racks 10, 10' which are identically constructed. Rack 10 consists of a flat rectangular body having a top wall 12, a bottom wall 14, opposite sidewalls 16 and 18 and opposite end walls 20 and 22.

Figure 3:
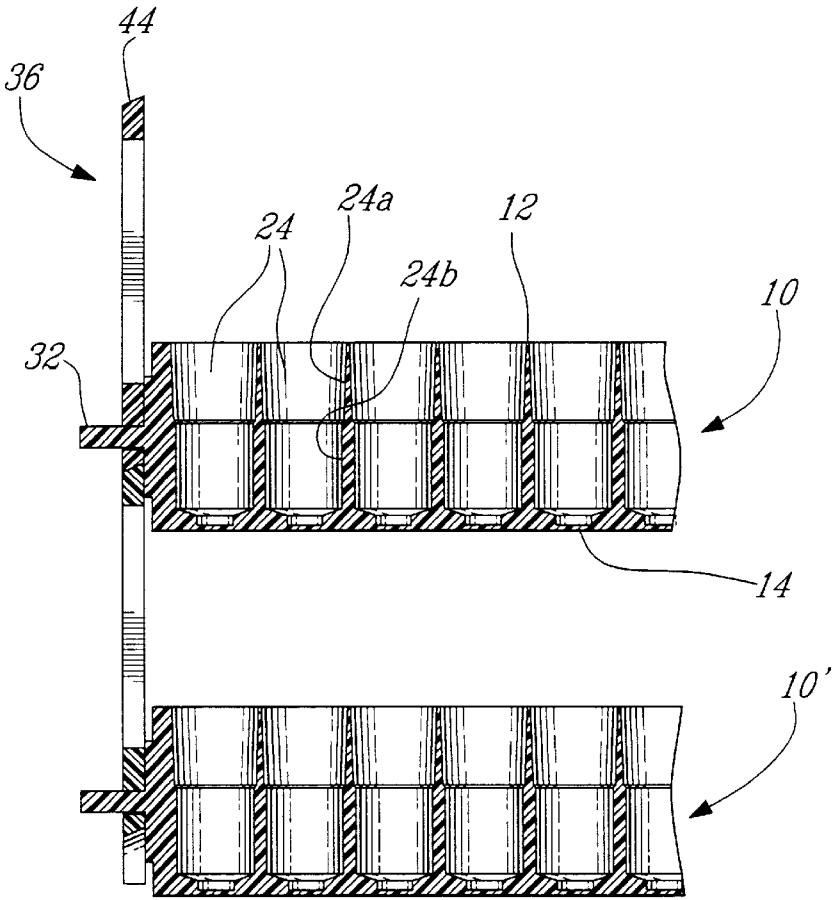
FIG. 3 is a cross sectional view taken along lines 3—3 of FIG. 1.

The top wall 12 displays a series of wells 24 disposed in rows and columns (80 wells being illustrated in the rack of FIG. 1). Each well has a small recess area 26 in its top wall so that numbers or letters (not shown) may be imprinted to identify the location of each well on the top wall. As can also be seen in FIG. 3, the wells 24 has a slightly tapered inner wall to receive test tubes for analytical purposes; also, they comprise two areas 24*a* and 24*b* having varying diameters to receive tubes of different outer diameters, for example 12 and 13 mm whereby the 12 mm tubes are less likely to become loose if they were received in a well which would have only an area 24*a* throughout its height.

Figure 4:
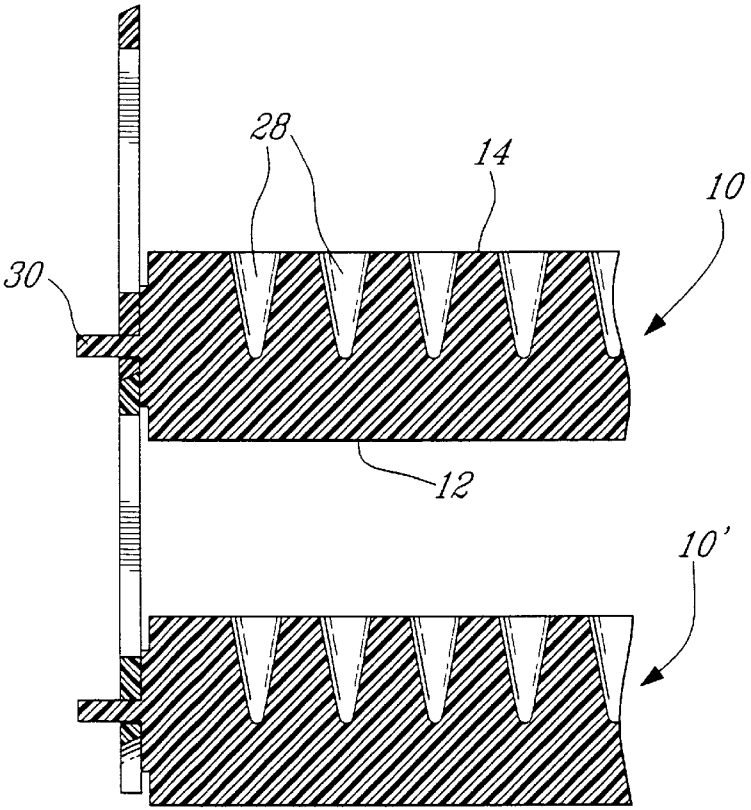
FIG. 4 is a cross sectional view taken along lines 4—4 of FIG. 2.

The rectangular body of racks shown in FIG. 2 have been inverted 180° with respect to that shown in FIG. 1. The bottom wall 14 (now top wall) also displays a series of wells 28 arranged in rows and columns (60 being shown). Although not shown, wall 14 may be impressed with letters and numbers to identify each well. Referring to FIG. 4, the wells 28 have a conical shape; these wells extend in body 10 in areas adjacent to wells 24.

Integrally formed to the opposite end walls 20 and 22 are rectangular shaped extensions 30 and 32.

Hence, the rack, in one position (FIG. 1), is adapted to receive 80 tubes made of polystyrene or polypropylene of 10 and 12 mm diameter such as tubes of 10×100 mm or 12×75 mm as well as tubes for cryogeny having a volume of 1.2 to 5.0 ml. The rack, in the second position (FIG. 2), is adapted to receive 60 tubes for micro-centrifugor of 1.5 and 2.0 ml volumes.

The rack 10 also comprises a pair of handles 34, 36 consisting of upper hand-gripping portions 38, 40 defining respective top edges 42, 44. The lower portions 46, 48 of the handles each comprise a rectangular shaped slot through which extends the respective end wall extensions 30 and 32. The lower portions 46, 48 also include a pair of opposite legs 50, 52 and 54, 56 thus defining a recessed area therebetween that has a dimension corresponding to the dimension of the top edges 42, 44 so that, once in a stack formation, these top edges will be confined in the recessed areas of the lower portions of a superposed rack.

The side wall 16 displays a series of vertical recessed areas 60 and a flat central area 62. Similarly, side wall 18 displays a series of recessed areas 64 and a flat central area 66. Their function will further be described below.

The body 10 as well as the handles are made of plastic material.

Figure 5:
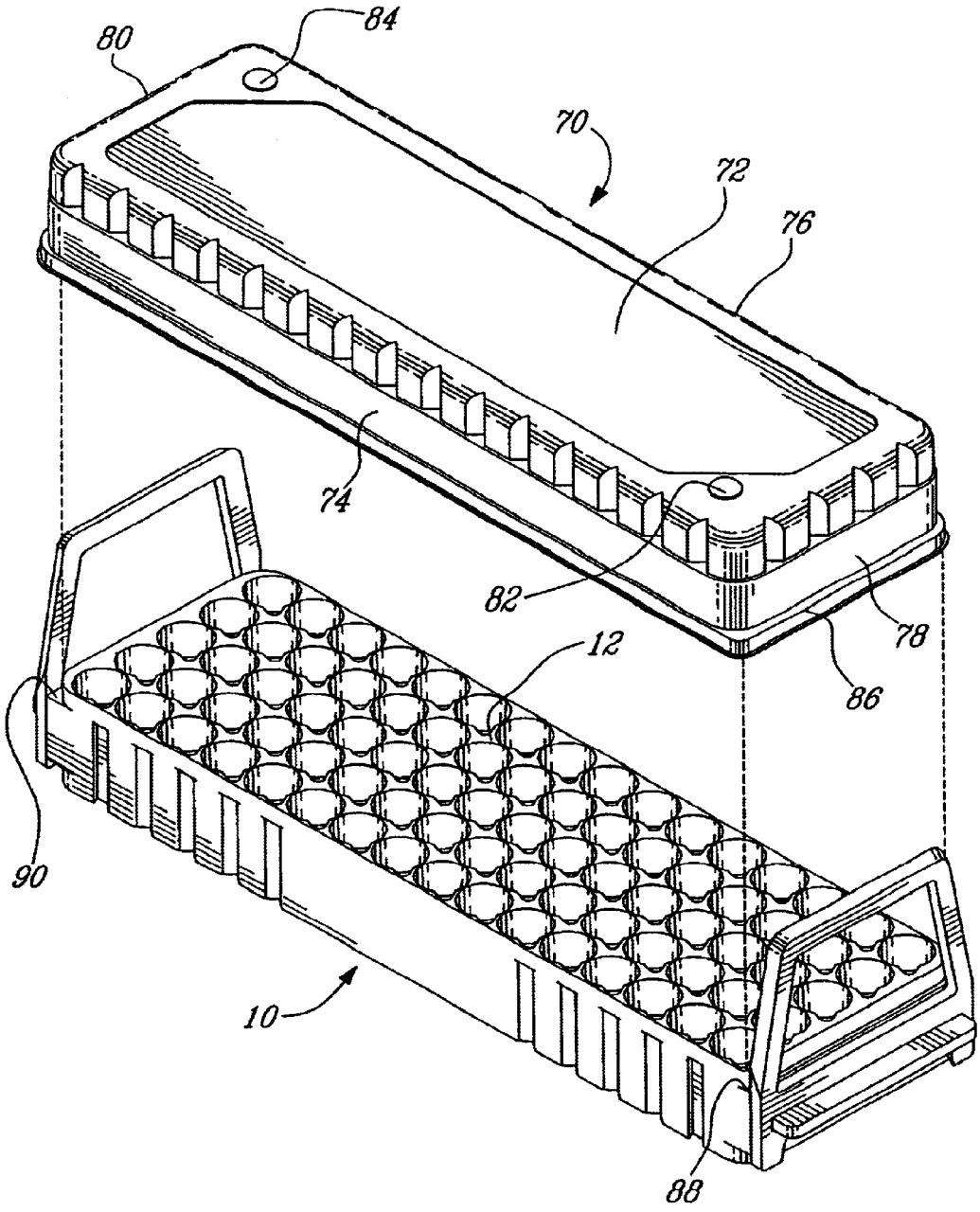
FIG. 5 is a perspective view showing the rack in its first position with a cover displayed thereabove.
Figure 6:
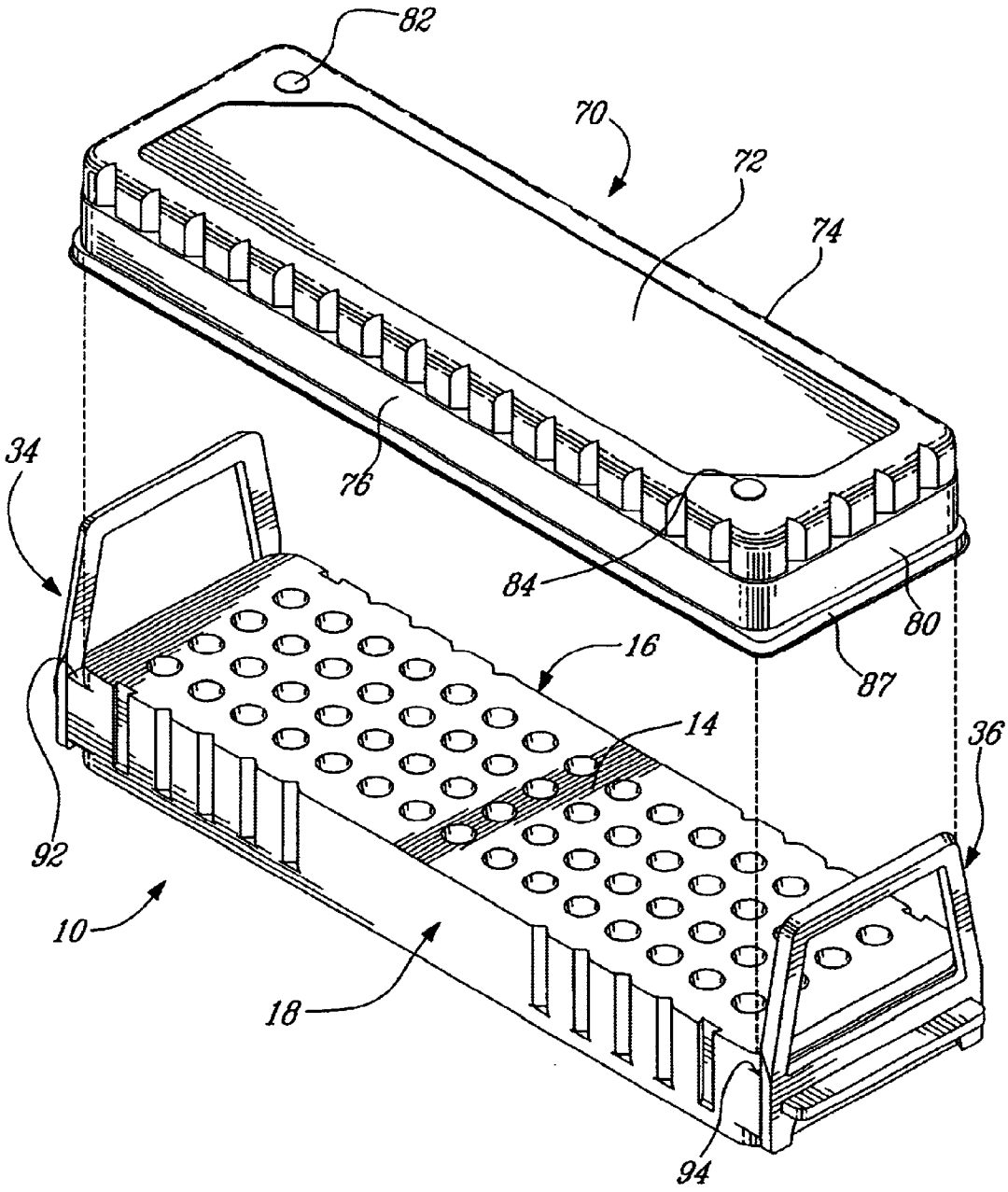
FIG. 6 is a perspective view showing the rack in its second position with the cover.

Referring to FIG. 5, in one form of the invention, the rack may comprise a cover, generally denoted 70, consisting of a top wall 72, opposite side walls 74 and 76 and opposite end walls 78, 80. The top wall 72 is generally flat and displays, at opposite corners, a pair of semi-circular protuberances 82 and 84. The lower edges of the opposite side walls and end walls of the cover are configured to be supported on corner areas (two being shown as 88 and 90) of the body 10. The cover 70 is also adapted to be supported, as illustrated in FIG. 6, when the body 10 is in its reverse position on corner areas (two being shown as 92 and 94) at the four corners of the body. The cover is preferably transparent and made of plastic material.

Figure 7:
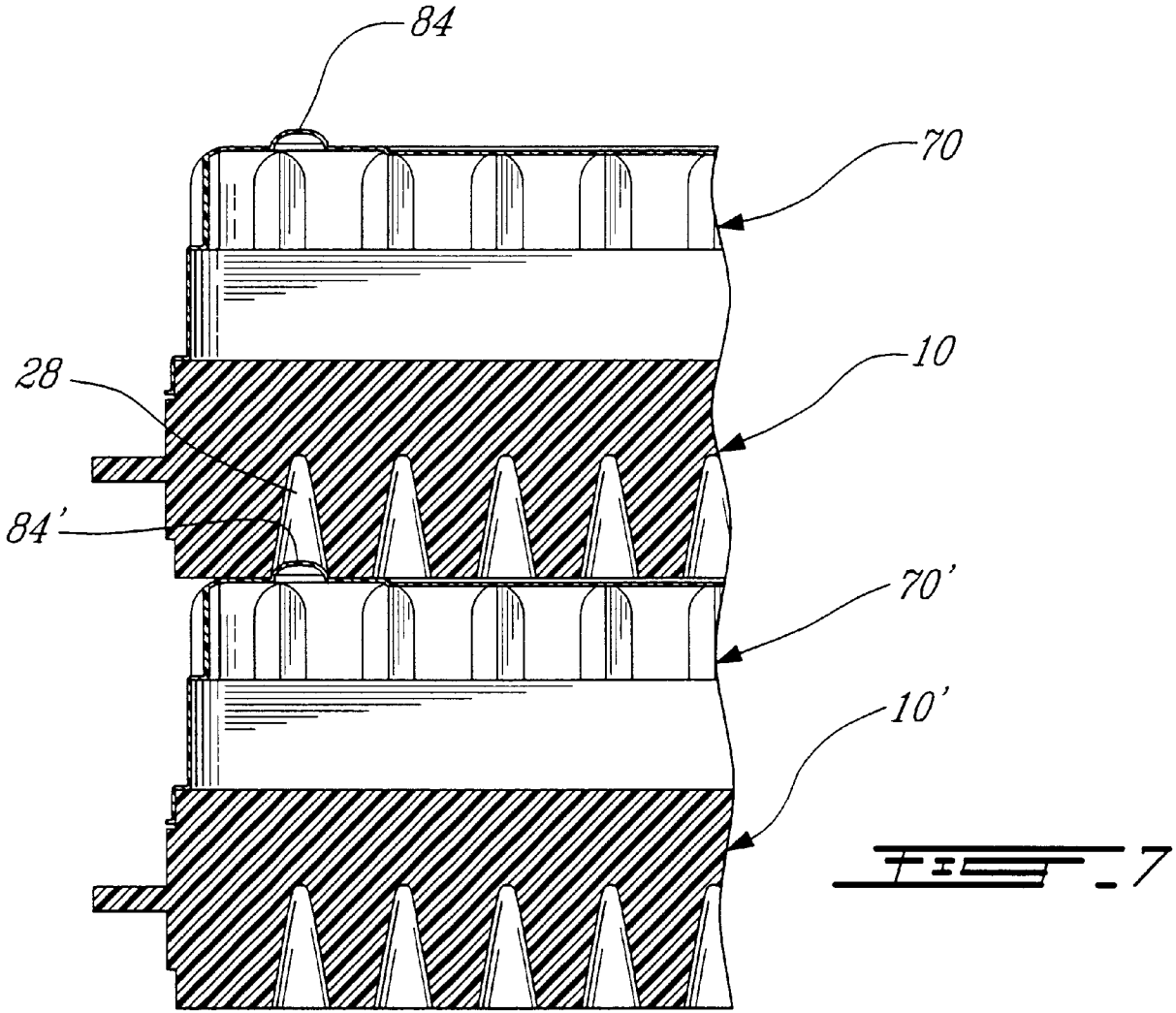
FIG. 7 is a cross sectional view similar to FIG. 4, showing parts of two stack racks with a cover.

FIG. 7 shows that two racks 10, 10' with their respective covers 70, 70' may be stacked in a secured manner with the protuberances 84 of the lower rack cover lodged in the entrance areas of the wells 28 of the superposed rack.

Figure 8:
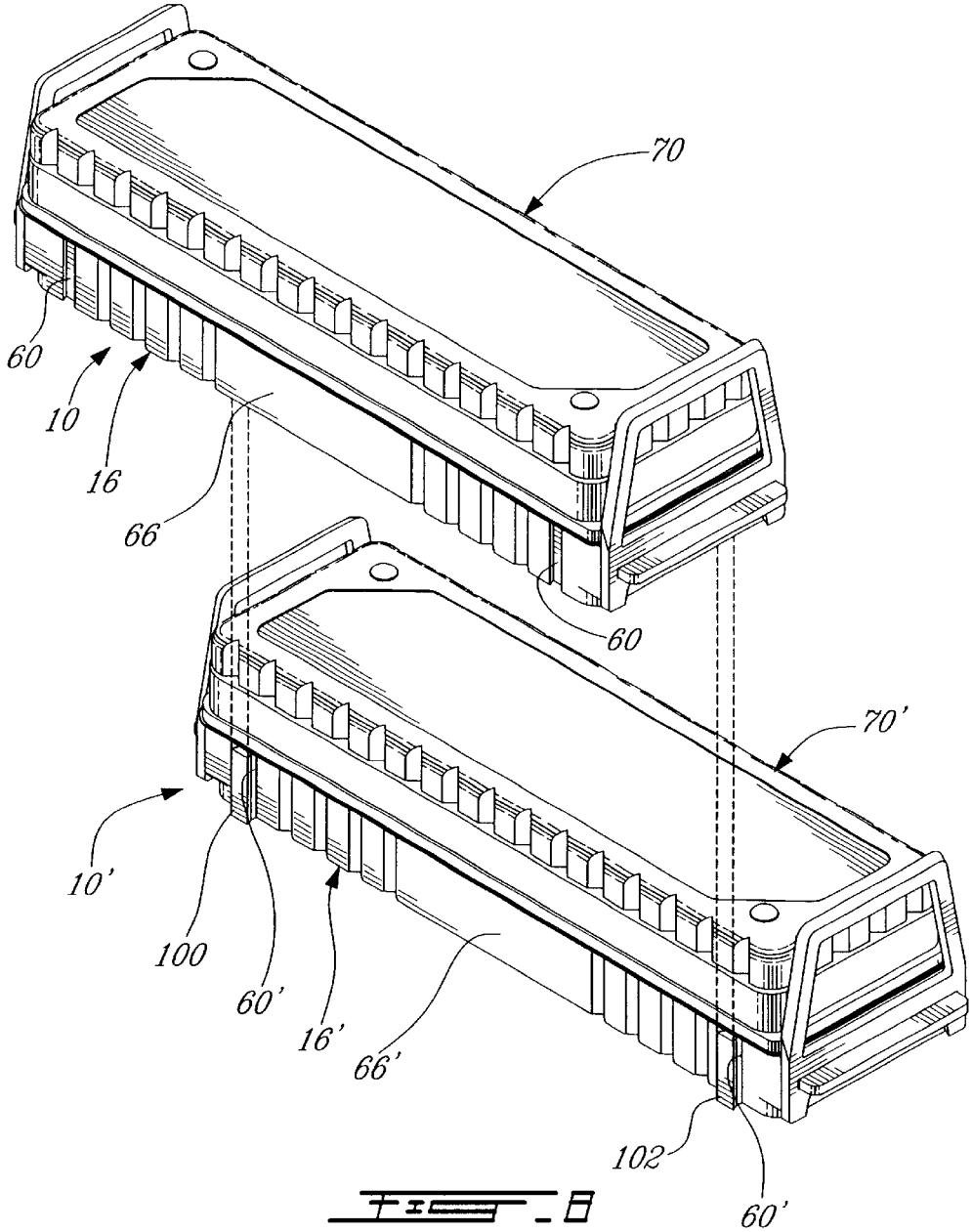
FIG. 8 is a perspective view showing two covered racks positioned to be juxtaposedly interconnected to one another.

Referring to FIG. 8, a pair of dowels 100 and 102 made of rigid plastic material are shaped so that a portion thereof may be slid into tight engagement in the recessed areas 60' of one body 10' with another portion of the dowel engaging a recessed area 64 (not shown) on the opposite side wall of the body 10. The flat central areas 66, 66' serve to affix information on the test tubes received in the racks. These dowels enable a side-by-side assembly of racks in either position with one rack of 80 tubes and the other connected rack with 60 tubes.

The present invention greatly improves storage in that, for one area, four racks containing 320 tubes may be stacked.

Although the invention has been described above with respect to one specific form, it will be evident to a person skilled in the art that it may be modified and refined in various ways. It is therefore wished to have it understood that the present invention should not be limited in scope, except by the terms of the following claims.

What is claimed is:

1. A modular test tube rack for stacking assembly with similarly constructed racks comprising:

a flat rectangular body having a top wall, a bottom wall, opposite side walls and opposite end walls; said body displaying, in a first position, a first series of wells extending from said top wall in a direction towards said bottom wall and adapted to receive tubes therein; each said end wall displaying a handle engaging extension;

a pair of handles respectively mounted at said opposite end walls; each said handle having a lower portion engaging with said extension of said end wall and a hand gripping upper portion displaying a top edge extending above said top wall of said body; said lower portion of said handles having a bottom edge so shaped as to anchor with the top edge of an underposed similarly constructed rack thereby enabling a vertically spaced stacking of two or more of said racks.

2. A modular test tube rack as defined in claim 1, wherein said body displays, a second series of wells extending from said bottom wall in a direction towards said top wall whereby, when said body is inverted to a second position inversed relative to said first position, it may receive other test tubes therein; said handles being reversibly mountable to said extensions so as to enable a stacking of racks when said body is in said second position.

3. A modular test tube rack as defined in claim 2, wherein said wells of said second series have a size smaller than that of said wells of the first series; said wells of said second series being located in said body adjacent said wells of said first series.

4. A modular test tube rack as defined in claim 3, wherein said wells of said first and second series are respectively arranged in rows and columns in said top wall and in said bottom wall; the number of wells extending from said top wall differing from the number of wells extending from said bottom wall.

5. A modular test tube rack as defined in claim 2, further comprising a cover having a top wall, opposite side walls and opposite end walls; said side walls and end walls of said cover having lower edges adapted to rest on corresponding edges of said side walls and end walls of said body in said first position and on corresponding edges of said side walls and end walls of said body in said second position.

6. A modular test tube rack as defined in claim 5, wherein said top wall of said cover displays at least one protuberance having a shape adapted to be received in a correspondingly located well entrance in said bottom wall of said body so as to allow a stack formation of covered racks.

7. A modular test tube rack as defined in claim 5, wherein said cover is made of transparent material.

8. A modular test tube rack as defined in claim 1, wherein said opposite side walls of said body displays dowel receiving slots; further comprising dowels in said slots so as to form an array of juxtaposed dowel interconnected racks.

9. A modular test tube rack as defined in claim 8, wherein said dowels are made of plastic material.

10. A modular test tube rack as defined in claim 1, wherein said body and said handles are made of plastic material.

11. A modular test tube rack as defined in claim 1, wherein said side walls of said body display an information receiving area.

12. A modular test tube rack as defined in claim 1, wherein said wells include two areas of different inner diameters.

13. A modular test tube rack for stacking assembly with similarly constructed racks comprising:

a flat rectangular body having a top wall, a bottom wall, opposite side walls and opposite end walls; said body displaying, in a first position, a series of wells extending from said top wall in a direction towards said bottom wall and adapted to receive tubes therein; each said end wall displaying a handle engaging extension;

a pair of handles respectively mounted at said opposite end walls; each said handle having a lower portion engaging with said extension of said end wall and a hand gripping upper portion displaying a top edge extending above said top wall of said body; said lower portion of said handles having a bottom edge so shaped as to anchor with the top edge of an underposed similarly constructed rack thereby enabling a vertically spaced stacking of two or more of said racks;

a cover having a top wall, opposite side walls and opposite end walls; said side walls and end walls of said cover having lower edges adapted to rest on corresponding edges of said side walls and end walls of said body in said first position and on corresponding edges of said side walls and end walls of said body in said second position;

wherein said body displays, a second series of wells extending from said bottom wall to said top wall whereby, when said body is inverted to a second position inversed relative to said first position, it may receive other test tubes therein; said handles being reversibly mountable to said extensions so as to enable a stacking of racks when said body is in said second position, said top wall of said cover displays at least one protuberance having a shape adapted to be received in a correspondingly located well entrance in said bottom wall of said body so as to allow a stack formation of covered racks; and said cover comprises a pair of said protuberances at diagonally opposite corners of said top wall of said cover.

14. A modular test tube rack as defined in claim 13, wherein said cover is made of transparent material.

15. A modular test tube rack as defined in claim 13, wherein said opposite side walls of said body displays dowel receiving slots; further comprising dowels in said slots so as to form an array of jaxtaposed dowel interconnected racks.

16. A modular test tube rack as defined in claim 13, wherein said side walls of said body display an information receiving area.

17. A modular test tube rack as defined in claim 13, wherein said walls include two areas of different inner diameters.

18. A modular test tube rack for stacking assembly with similarly constructed racks comprising:

a flat rectangular body having a top wall, a bottom wall, opposite side walls and opposite end walls; said body displaying, in a first position, a series of wells extending from said top wall in a direction towards said bottom wall and adapted to receive tubes therein; each said end wall displaying a handle engaging extension;

a pair of handles respectively mounted at said opposite end walls; each said handle having a lower portion engaging with said extension of said end wall and a hand gripping upper portion displaying a top edge extending above said top wall of said body; said lower portion of said handles having a bottom edge so shaped as to anchor with the top edge of an underposed similarly constructed rack thereby enabling a vertically spaced stacking of two or more of said racks, wherein said extension of said end wall has a rectangular shape and wherein said lower portion of said handles displays a rectangular shaped opening to receive said rectangular extension of said end wall of said rack.

* * * * *